US011149927B2

(12) United States Patent
Chen et al.

(10) Patent No.: US 11,149,927 B2
(45) Date of Patent: Oct. 19, 2021

(54) LED LIGHTING APPARATUS

(71) Applicant: XIAMEN ECO LIGHTING CO. LTD., Xiamen (CN)

(72) Inventors: Chunteng Chen, Xiamen (CN); Lei Zhang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/804,884

(22) Filed: Feb. 28, 2020

(65) Prior Publication Data

US 2020/0278106 A1 Sep. 3, 2020

Related U.S. Application Data

(60) Provisional application No. 62/812,709, filed on Mar. 1, 2019.

(51) Int. Cl.

| | |
|---|---|
| ***F21V 21/30*** | (2006.01) |
| ***F21V 15/015*** | (2006.01) |
| ***F21V 23/00*** | (2015.01) |
| *F21Y 103/10* | (2016.01) |
| *F21Y 115/10* | (2016.01) |

(52) U.S. Cl.

CPC ..... *F21V 21/30* (2013.01); *F21V 15/015* (2013.01); *F21V 23/003* (2013.01); *F21Y 2103/10* (2016.08); *F21Y 2115/10* (2016.08)

(58) Field of Classification Search

CPC ..... F21V 21/30; F21V 15/015; F21V 23/003; F21Y 2115/10; F21Y 2103/10

See application file for complete search history.

(56) References Cited

U.S. PATENT DOCUMENTS

| | | | | |
|---|---|---|---|---|
| 10,352,510 | B2 * | 7/2019 | Van Winkle | F21S 4/10 |
| 2011/0255286 | A1 * | 10/2011 | Christ | F21L 4/04 362/249.02 |
| 2016/0209015 | A1 * | 7/2016 | Mumma | F21V 21/22 |

FOREIGN PATENT DOCUMENTS

| | | | | |
|---|---|---|---|---|
| CN | 102637450 | A * | 8/2012 | G11C 8/10 |

* cited by examiner

*Primary Examiner* — Donald L Raleigh

(74) *Attorney, Agent, or Firm* — Chun-Ming Shih; Lanway IPR Services

(57) ABSTRACT

A LED tube has a first tube section and a second tube section. The first tube section and the second tube section are connected with a rotation structure. With the rotation structure, the first tube section and the second tube section may be rotated with respect to each other along a rotation axis.

15 Claims, 10 Drawing Sheets

LED LIGHTING APPARATUS

RELATED APPLICATION

The present application claims priority of a provisional application of U.S. Patent Application No. 62/812,709.

FIELD OF INVENTION

The present invention is related to a light tube apparatus, and more particularly related to a light tube apparatus that has multiple operation modes.

BACKGROUND

Light tubes are widely used in modern life. When LED technologies keep developing, more and more light tubes use LED components to implement light tubes to achieve high energy efficiency and other advantages of LED technologies.

Light tubes usually are designed with elongated shapes. Their shipping often causes problems particularly through global movement. It is important and beneficial to develop flexible light tubes to be more convenient and cost effective.

SUMMARY OF INVENTION

In some embodiments, a lighting apparatus includes a first tube section, a second tube section and a rotation structure.

The first tube section has a first section housing, a first light passing cover, and a first light source. The first section housing and the first light passing cover form a first container enclosing the first light source. The first light is emitted from the first light source passing through the first light passing cover.

The second tube section has a second section housing, a second light passing cover, and a second light source. The second section housing and the section light passing cover form a second container enclosing the first light source. A second light is emitted from the second light source passing through the second light passing cover.

The rotation structure is connecting to a first rotation end of the first tube section and a second rotation end of the second tube section. The first tube section is rotatable with respect to the second tube section for folding the first tube section to the second tube section.

In some embodiments, the first section housing and the second section housing prevent light pass through the first section housing and the second section housing.

In some embodiments, the first tube section has a first main light direction. The second tube section has a second main light direction. The first main light direction and the second main light direction are facing to each other when the first tube section is folded to contact the second tube section.

In some embodiments, the first tube section has a first main light direction. The second tube section has a second main light direction. The first main light direction and the second main light direction are opposite to each other when the first tube section is folded to contact the second tube section.

In some embodiments, the first tube section has a first cap end. The second tube section has a second cap end. The first cap end and the second cap end receive a power input supplying to the first light source and the second light source.

In some embodiments, the first tube section has a first cap end, the first light source receives a power from the first cap end and the rotation end.

In some embodiments, the first tube section has a first main light direction. The second tube section has a second main light direction. The first main light direction and the second main light direction are parallel to each other when the first tube section is folded to contact the second tube section.

In some embodiments, the first light source and the second light source are controlled to emit a first light pattern when the first tube section is not folded to the second tube section. The first light source and the second light source are controlled to emit a second light pattern when the first tube section is filed to the second tube section. The first light pattern and the second light pattern are different.

In some embodiments, the first tube section has an elongated box shape. The first light passing cover has a top cover and two lateral covers for emitting light in three directions.

In some embodiments, the rotation structure is detachable.

In some embodiments, the first tube section has a first cap end and a first hidden cap. The second tube section has a second cap end and a second hidden cap. The first cap end and the first hidden cap has the same interface. The first hidden cap is concealed by the rotation structure when the rotation structure is not detached from the first tube section.

In some embodiments, the first cap end and the first hidden cap match a T8 light tube socket.

In some embodiments, the first cap and the second hidden cap match a T5 light tube socket.

In some embodiments, the rotation structure is a rotation shaft.

In some embodiments, the first light source and the second light source are electrically connected via a conductive unit attached to the rotation shaft.

In some embodiments, the first tube section has a first cap end opposite to the first rotation end. The second tube section has a second cap end opposite to the second rotation end. The first light source receives a first driving current via the first cap end, the second light source receives a second driving current from the second cap end. The first light source and the second light source are electricity insulated at the rotation shaft.

In some embodiments, the lighting apparatus also has a first driver circuit and a second driver circuit. The first driver circuit is disposed in the first tube section. The second driver circuit is disposed in the second tube section. The first driver circuit and the second driver circuit work together to generate a shared driving current to the first light source and the second light source.

In some embodiments, the first driver circuit and the second driver circuit generate heat with a relative amount ratio less than 10%.

In some embodiments, the first tube section has a first cap end, the second tube section has a second cap end, the first cap end having a connector structure to be further connected to another lighting apparatus mentioned above to integrate as a longer lighting device.

In some embodiments, the rotation structure contains an attached device for adding a function to the lighting apparatus.

DESCRIPTION OF EMBODIMENTS

Figure 5A:
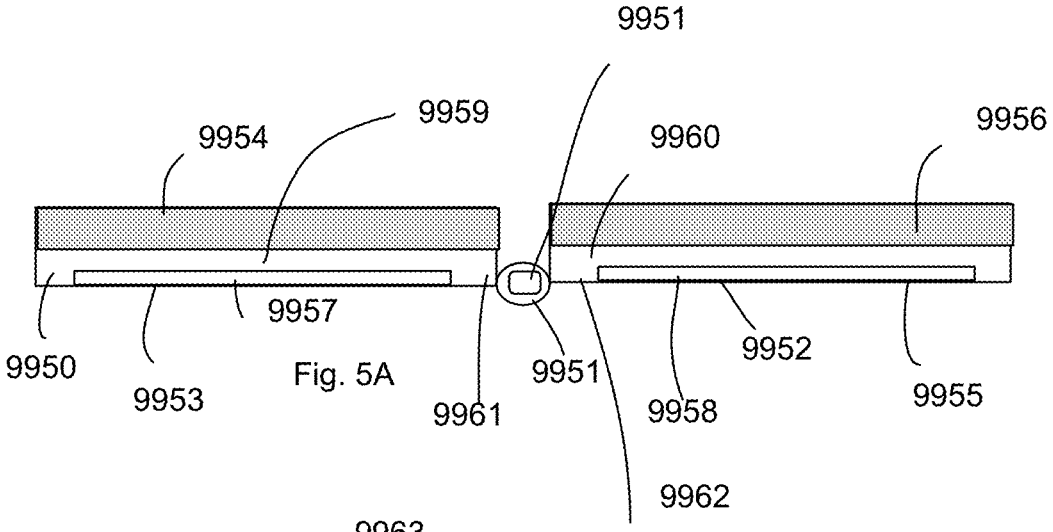
FIG. 5A illustrates a status of an embodiment.
Figure 5B:
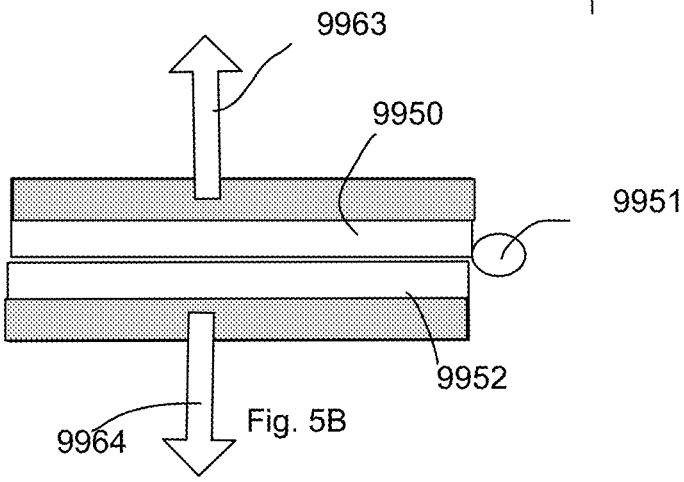
FIG. 5B shows another status of the embodiment in FIG. 5A.

Please refer to FIG. 5A and FIG. 5B, a lighting apparatus has a first tube section 9950, a second tube section 9952 and a rotation structure 9951.

The first tube section 9950 has a first section housing 9953, a first light passing cover 9954, and a first light source 9957. The first section housing 9953 and the first light passing cover 9954 form a first container 9959 enclosing the first light source 9957. The first light is emitted from the first light source 9957 passing through the first light passing cover 9954.

The second tube section 9952 has a second section housing 9955, a second light passing cover 9956, and a second light source 9958. The second section housing 9955 and the section light passing cover 9956 form a second container 9960 enclosing the first light source 9952. A second light is emitted from the second light source 9958 passing through the second light passing cover 9956.

The rotation structure 9951 is connecting to a first rotation end 9961 of the first tube section 9950 and a second rotation end 9962 of the second tube section 9952. The first tube section 9950 is rotatable with respect to the second tube section 9952 for folding the first tube section 9950 to the second tube section 9952.

In some embodiments, the first section housing 9954 and the second section housing 9956 prevent light pass through the first section housing and the second section housing.

In some embodiments, the first tube section 9950 has a first main light direction 9963. The second tube section 9952 has a second main light direction 9964. The first main light direction 9963 and the second main light direction 9964 are opposite to each other when the first tube section 9950 is folded to contact the second tube section 9952.

Figure 6A:
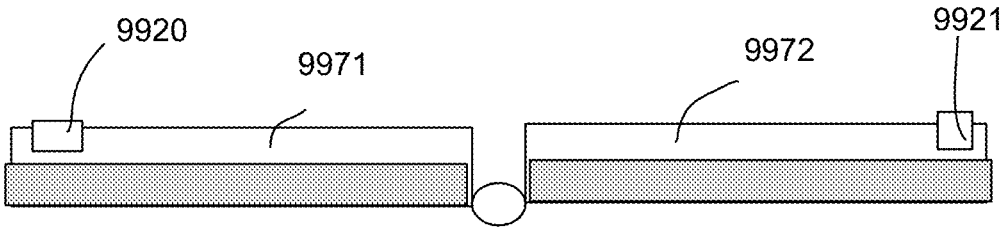
FIG. 6A shows another embodiment.
Figure 6B:
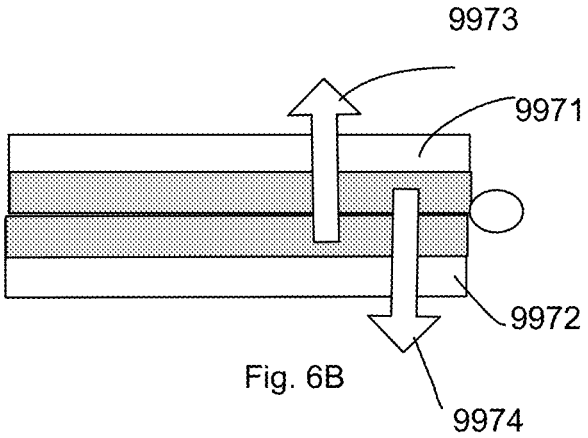
FIG. 6B shows another status of the embodiment in FIG. 6A.

In FIG. 6A and FIG. 6B, the first tube section 9971 has a first main light direction 9974. The second tube section 9972 has a second main light direction 9973. The first main light direction 9974 and the second main light direction 9973 are facing to each other when the first tube section 9971 is folded to contact the second tube section 9972.

Figure 8A:
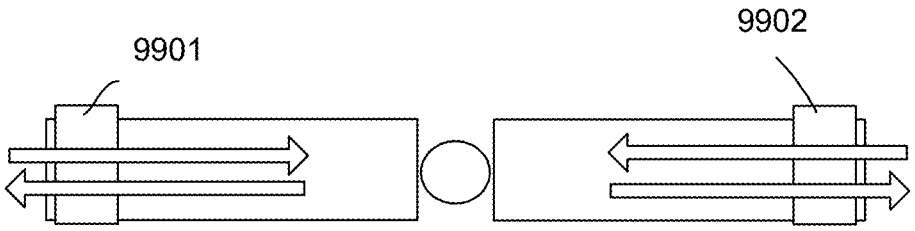
FIG. 8A shows an example of power movement.
Figure 8B:
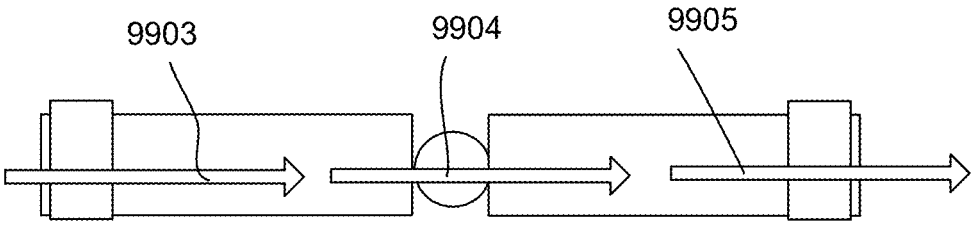
FIG. 8B shows another type of power movement.

Please refer to FIG. 8A and FIG. 8B. In FIG. 8A, the first tube section has a first cap end 9901. The second tube section has a second cap end 9902. The first cap end 9901 and the second cap end 9902 receive a power input supplying to the first light source and the second light source. For example, the first light source in the first tube section receives a power from the first cap end 9901, the arrow shows the current moving direction. The second light source in the second tube section receives a power from the second cap end 9902, the arrow showing the current moving direction. In other words, the light sources in different tube sections receive power independently. The rotation structure between the tube sections does not route electricity for the light sources.

Please refer to FIG. 8B, the first tube section has a first cap end, the first light source receives a power from the first cap end and the rotation end. The current 9903 moves into the first tube section, then the current 9904 moves through a conductive unit, e.g. a wire or a metal path, and the current 9905 continues moving forwardly. The power is supplied from two end caps of the tube sections in this example.

Figure 7A:
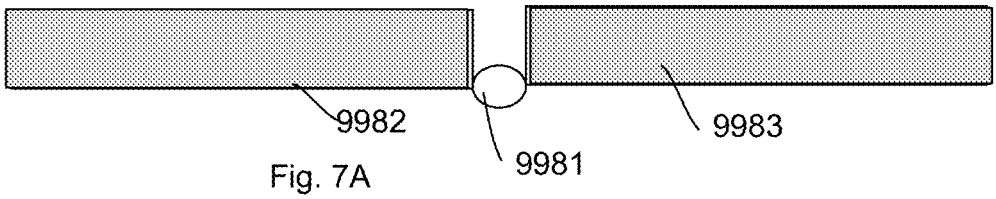
FIG. 7A shows another embodiment.
Figure 7B:
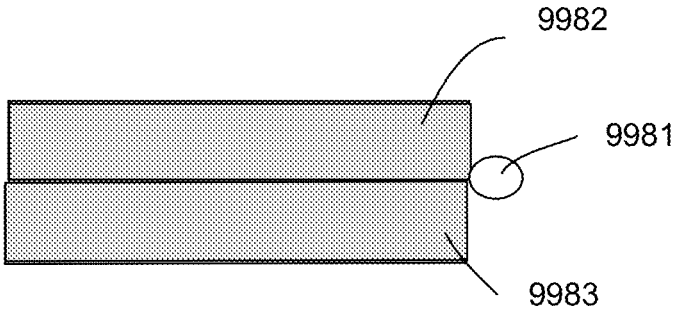
FIG. 7B shows another status of the embodiment in FIG. 7A.
Figure 7C:
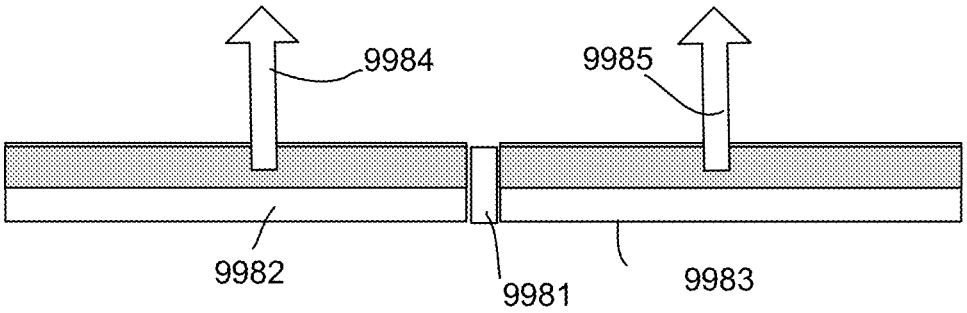
FIG. 7C shows another view of FIG. 7B.

Please refer to FIG. 7A, FIG. 7B and FIG. 7C. FIG. 7A shows a unfolded status of an embodiment. FIG. 7B shows a folded status of the embodiment. FIG. 7C shows a side view of the embodiment of FIG. 7B.

In FIG. 7A, FIG. 7B and FIG. 7C, the first tube section 9982 has a first main light direction 9984. The second tube section 9983 has a second main light direction 9985. The first main light direction 9984 and the second main light direction 9985 are parallel to each other when the first tube section 9982 is folded to contact the second tube section 9983.

In some embodiments, the first light source and the second light source are controlled to emit a first light pattern when the first tube section is not folded to the second tube section. The first light source and the second light source are controlled to emit a second light pattern when the first tube section is filed to the second tube section. The first light pattern and the second light pattern are different.

For example, when the first tube section is not folded with the second tube section, the first light pattern has optical characteristics of a first luminance level, a first color temperature and/or a first color. When the first tube section is folded with the second tube section, the second light pattern may be different from the first light pattern.

In some embodiments, the first tube section has an elongated box shape. The first light passing cover has a top cover and two lateral covers for emitting light in three directions.

In some embodiments, the rotation structure is detachable. For example, the rotation structure may be a detachable hinge. The hinge may be detachable from one tube section, or completely removed from any tube section. When the rotation structure is installed, two adjacent tube sections may be rotated to each other.

Figure 9:
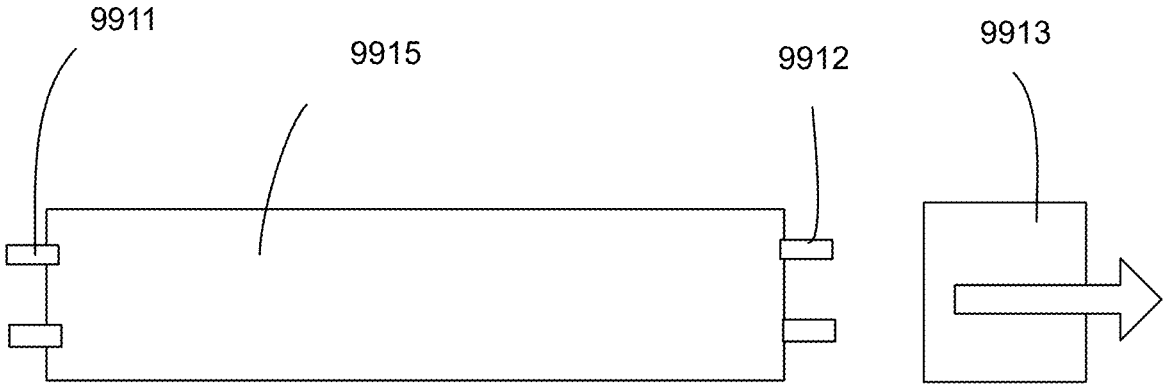
FIG. 9 shows another example.

Please refer to FIG. 9, the first tube section has a first cap end 9911 and a first hidden cap 9912. The second tube section has a second cap end and a second hidden cap. The first cap end 9911 and the first hidden cap 9912 has the same interface. The first hidden cap 9912 is concealed by the rotation structure 9913 when the rotation structure is not detached from the first tube section.

In some embodiments, the first cap end and the first hidden cap match a T8 light tube socket. For example, the tube section 9915 has two ends compatible to be installed to a T8 light tube socket.

In some embodiments, the first cap and the second hidden cap match a T5 light tube socket.

In some embodiments, the rotation structure is a rotation shaft.

In some embodiments, the first light source and the second light source are electrically connected via a conductive unit attached to the rotation shaft.

In some embodiments, the first tube section has a first cap end opposite to the first rotation end. The second tube section has a second cap end opposite to the second rotation end. The first light source receives a first driving current via the first cap end, the second light source receives a second driving current from the second cap end. The first light source and the second light source are electricity insulated at the rotation shaft.

Please refer to FIG. 6A, the lighting apparatus also has a first driver circuit 9920 and a second driver circuit 9921. The first driver circuit 9920 is disposed in the first tube section 9971. The second driver circuit 9921 is disposed in the second tube section 9972. The first driver circuit 9920 and the second driver circuit 9921 work together to generate a shared driving current to the first light source and the second light source.

Furthermore, the first driver circuit 9920 and the second driver circuit 9921 generate heat with a relative amount ratio less than 10%. In other words, the heat generation is calculated for components of the driver and components are evenly arranged in two tube sections to perform heat balance for enhancing heat dissipation.

Figure 10:
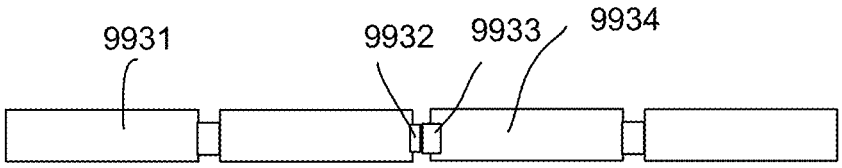
FIG. 10 shows connection of two lighting apparatuses.

In FIG. 10, the first tube section 9931 has a first cap end, the second tube section has a second cap end, the first cap end having a connector structure 9932 to be further connected to a corresponding connector 9933 another lighting apparatus 9934 mentioned above to integrate as a longer lighting device.

Please refer to FIG. 5A, the rotation structure may contain an attached device 9951 for adding a function to the lighting apparatus. The attached device 9951 may share power as the light sources in tube sections. The attached device 9951 may receive a wireless external command from a remote device and controls the light sources to turn on, turn off, change luminance level, change color temperature, or any operation. The attached device may be a sensor providing information to the driver to determine how to adjust operation of the lighting apparatus. The attached device 9951 may be a speaker for providing sound effect. The attached device 9951 may contain a battery for providing emergency light function. The position of the rotation structure is suitable for adding the attached device 9951 and operate smoothly, e.g. less antenna or heat issues.

Figure 1:
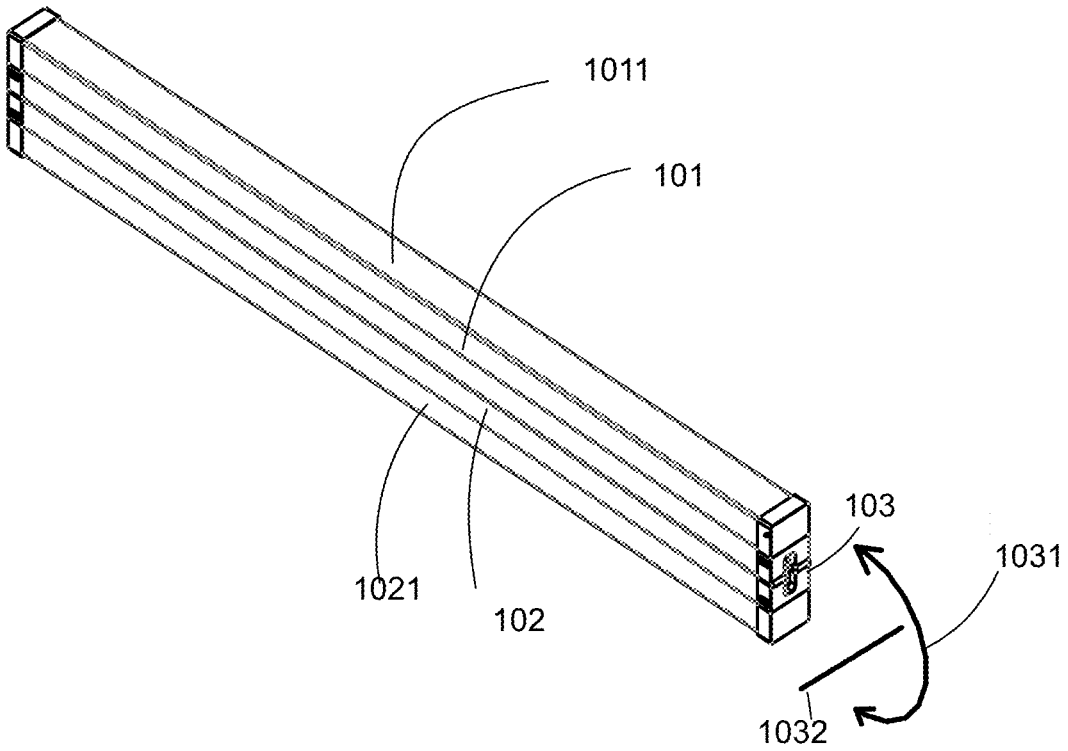
FIG. 1 illustrates a light tube embodiment, in which the light tube is folded.

In FIG. 1, a LED tube has a first tube section 101 and a second tube section 102. LED modules are installed in both the first tube section 101 and the second tube section 102. There are two covers 1011, 1021 allowing output lights of the modules of the first tube section 101 and the second tube section 102 to escape outside the LED tube.

The first tube section 101 and the second tube section 102 are connected with a rotation structure 103. With the rotation structure 103, the first tube section 101 and the second tube section 102 may be rotated with respect to each other along a rotation axis 1032, as illustrated by the rotation arrow 1031.

Figure 2:
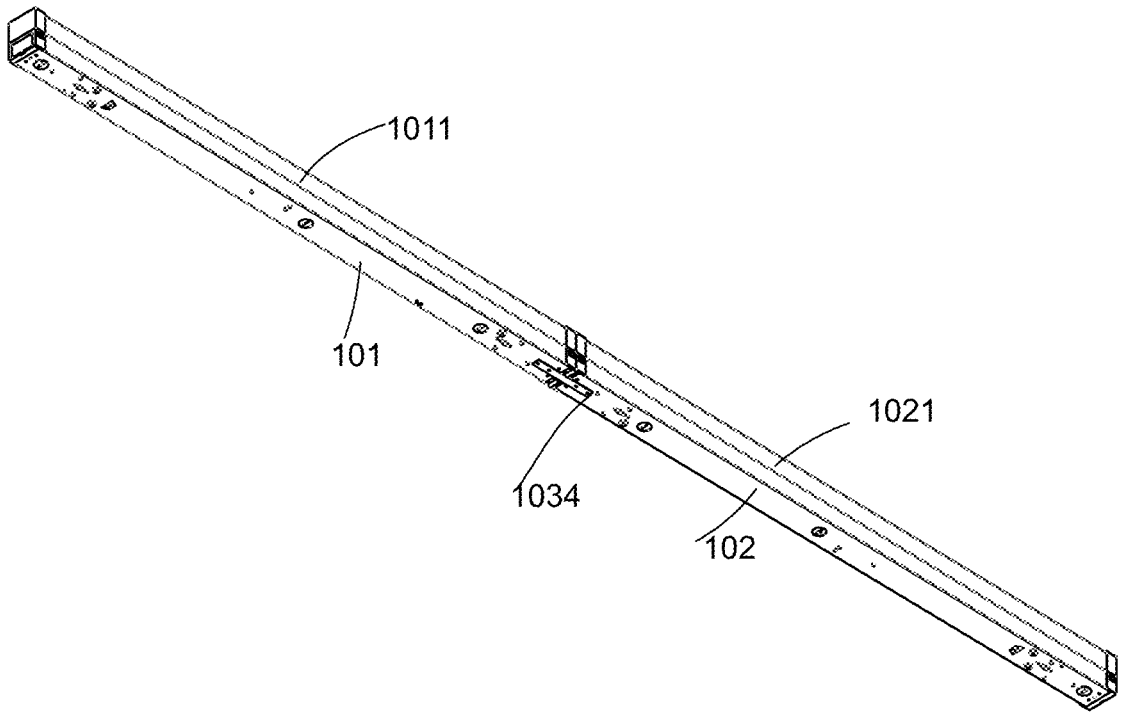
FIG. 2 illustrates the light tube embodiment, in which the light tube is unfolded.

FIG. 2 shows when the LED tube apparatus is unfolded by rotating the first tube section 101 with respect to the second tube section. Compared with the status of FIG. 1, the same LED tube apparatus now has a double length. For example, the length of tube section 101 is 4 feet, which defines the length of the LED tube. When the LED tube id unfolded, the length of the LED tube reaches 8 feet.

The rotation structure 103 may be a hinge with a rotation axis so that the first tube section 101 may be rotated with respect to the second tube section 102. In other embodiments, the rotation structure 103 may be a simple foldable plate with two ends fixed to the tube sections 101, 102 and may be folded. For example, a plastic plate with a folding groove keeps the first tube section 101 to be connected to the second tube section 102 while the first tube section 101 may be rotated with respect to the second tube section 102.

After the rotation, a fixture structure 1034 may be used to fix the unfolded shape of the first tube section 101 and the second tube section 102. For example, the fixture structure may be a separate component that is attached on back sides of the first tube section 101 and the second tube section 102. In some other embodiments, plugging locks disposed on facing ends of the first tube section 101 and the second tube section 102 may be used for fixing the two unfolded tube sections 101, 102 without an additional fixture structure 1034.

The LED modules in the first tube section 101 and the second tube section 102 may be electrically connected in series or in parallel. In addition, the LED modules in the first tube section 101 and the second tube section 102 may be controlled separately, e.g. turned off/on or adjusting their color temperatures, colors, etc.

Figure 3:
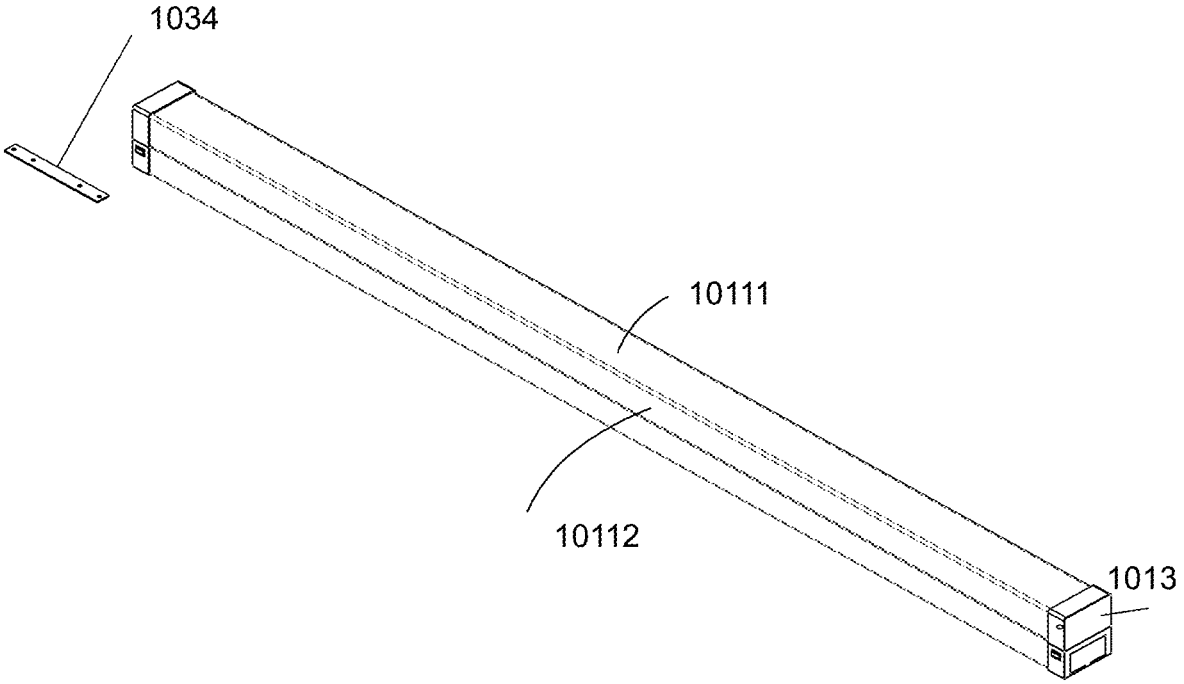
FIG. 3 illustrates a tube section in an embodiment.

FIG. 3 illustrates an enlarged view of the first tube section 101 and an example of the fixture structure 1034. The cover of the first tube section 101 may be a diffuser and has two or three light emitting sides, e.g. the top cover 10111 and two lateral covers 10112.

In the example of FIG. 3, there is a lateral cover 1013 that may be opened for connecting a terminal of one LED tube apparatus to another LED tube apparatus.

Figure 4:
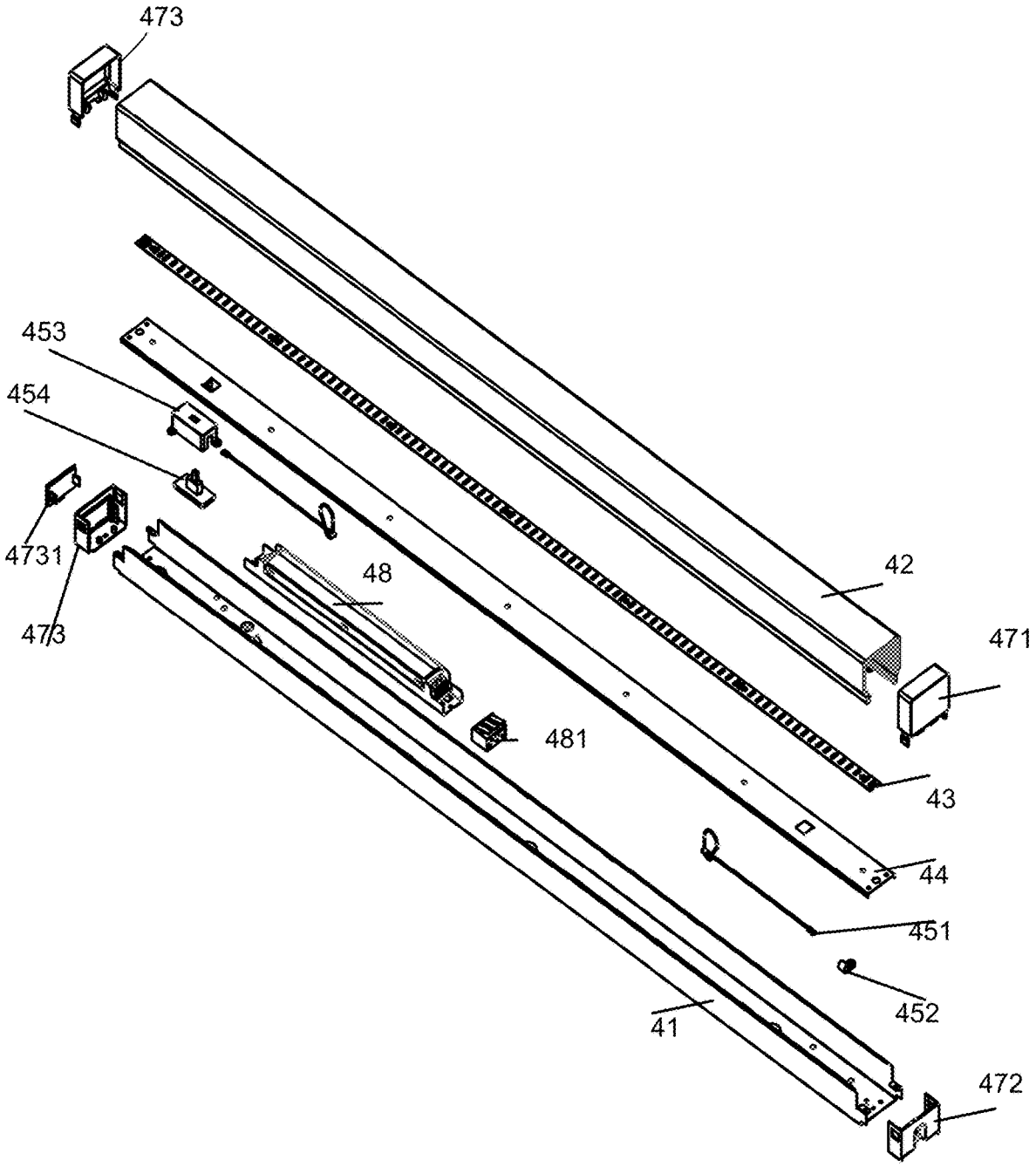
FIG. 4 is an exploded diagram showing components of the light tube embodiment.

FIG. 4 is an exploded view of a tube section example. In FIG. 4, the tube section includes a section housing 41, a cover 42, a LED plate 43, a heat sink plate 44, a safety ring 451, a line buckle 452, a switch box 453, a switch device 454, a driver module 48, a terminal 481, a top lateral cover 471, a middle lateral cover 472, a side cover 473.

The LED plate 43 is mounted with LED modules that receive driving current from the driver module 48. Light passes through or guided by the cover 42. The heat sink plate 44 is attached on back side of the LED plate 43 for heat dissipation. The safety ring 451 is used for being installed in a corresponding station that has a hook for hanging the safety ring 451 to prevent falling down in accident.

The line buckle 452 is used for fixing wires, and the switch device 454 is installed in the switch box 453 to be operated by a user. The terminal 481 is used for connecting to an external power source.

The top lateral cover 471, the middle lateral cover 742 and the side cover 473 seal two lateral sides of the LED tube apparatus. When connected to another LED tube apparatus, the side cover 473 may be opened for exposing a connecting terminal to be connected to corresponding terminal of another LED tube apparatus.

In some embodiments, the LED plate 43 is plugged to other components and may be easily replaced by opening the cover 42. The switch device 454 may be operated to select a color temperature or a desired setting that is sent to the driver module 48 to generate corresponding light output.

In some embodiments, the switch box 453 is concealed by the cover 42. By opening the cover 42, users may operate the switch device 454 to adjust setting of the driver module and the LED plate.

The description above is only an optional embodiment, it is not intended to be limited. Any modification, replacement or improvement etc. made within the spirit and principle of an embodiment should be included in the scope of an embodiment.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

The invention claimed is:

1. A lighting apparatus comprising:

a first tube section having a first section housing, a first light passing cover, and a first light source, the first section housing and the first light passing cover forming a first container enclosing the first light source, a first light emitted from the first light source passing through the first light passing cover;

a second tube section having a second section housing, a second light passing cover, and a second light source, the second section housing and the section light passing cover forming a second container enclosing a second light source, a second light emitted from the second light source passing through the second light passing cover; and a rotation structure, connecting to a first rotation end of the first tube section and a second rotation end of the second tube section, the first tube section being rotatable with respect to the second tube section for folding the first tube section to the second tube section, wherein the first tube section has a first cap end, the second tube section has a second cap end, the first cap end having a connector structure to be further connected to another lighting apparatus to integrate as a longer lighting device, wherein the rotation structure is detachable, wherein the first tube section has a first cap end and a first hidden cap, the second tube section has a second cap end and a second hidden cap, the first cap end and the first hidden cap has the same interface, the first hidden cap is concealed by the rotation structure when the rotation structure is not detached from the first tube section.

2. The lighting apparatus of claim 1, wherein the first section housing and the second section housing prevent light passing through the first section housing and the second section housing.

3. The lighting apparatus of claim 2, wherein the first tube section has a first main light direction, the second tube section has a second main light direction, the first main light direction and the second main light direction are facing to each other when the first tube section is folded to contact the second tube section.

4. The lighting apparatus of claim 2, wherein the first tube section has a first main light direction, the second tube section has a second main light direction, the first main light direction and the second main light direction are opposite to each other when the first tube section is folded to contact the second tube section.

5. The lighting apparatus of claim 4, wherein the first tube section has a first cap end, the second tube section has a second cap end, the first cap end and the second cap end receive a power input supplying to the first light source and the second light source.

6. The lighting apparatus of claim 4, wherein the first tube section has a first cap end, the first light source receives a power from the first cap end and the rotation end.

7. The lighting apparatus of claim 2, wherein the first tube section has a first main light direction, the second tube section has a second main light direction, the first main light direction and the second main light direction are parallel to each other when the first tube section is folded to contact the second tube section.

8. The lighting apparatus of claim 1, wherein the rotation structure contains an attached device for adding a function to the lighting apparatus.

9. The lighting apparatus of claim 1, wherein the first tube section has an elongated box shape, the first light passing cover has a top cover and two lateral covers for emitting light in three directions.

10. The lighting apparatus of claim 1, wherein the first cap end and the first hidden cap match a T8 light tube socket.

11. The lighting apparatus of claim 1, wherein the first cap end and the second hidden cap match a T5 light tube socket.

12. The lighting apparatus of claim 1, wherein the rotation structure is a rotation shaft.

13. The lighting apparatus of claim 12, wherein the first light source and the second light source are electrically connected via a conductive unit attached to the rotation shaft.

14. The lighting apparatus of claim 12, wherein the first tube section has a first cap end opposite to the first rotation end, the second tube section has a second cap end opposite to the second rotation end, the first light source receives a first driving current via the first cap end, the second light source receives a second driving current from the second cap end, the first light source and the second light source are electricity insulated at the rotation shaft.

15. The lighting apparatus of claim 1, further comprising a first driver circuit and a second driver circuit, wherein the first driver circuit is disposed in the first tube section, the second driver circuit is disposed in the second tube section, the first driver circuit and the second driver circuit work together to generate a shared driving current to the first light source and the second light source.

* * * * *